US008875667B2

(12) United States Patent
Palazzolo et al.

(10) Patent No.: US 8,875,667 B2
(45) Date of Patent: Nov. 4, 2014

(54) OIL COOLER

(75) Inventors: Christopher K. Palazzolo, Ann Arbor, MI (US); Darren Sipila, Chesterfield, MI (US); Jagadish Sorab, West Bloomfield, MI (US); Chuck Raymond Kvasnicka, Grosse Ile, MI (US); Michael Edward Solski, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 509 days.

(21) Appl. No.: 13/342,659

(22) Filed: Jan. 3, 2012

(65) Prior Publication Data

US 2013/0167785 A1 Jul. 4, 2013

(51) Int. Cl.
*F01P 11/08* (2006.01)

(52) U.S. Cl.
USPC ..... 123/41.33; 123/196 AB

(58) Field of Classification Search
USPC ..... 123/41.33, 196 AB, 54.4–54.8; 184/6.22, 104.2, 104.3
See application file for complete search history.

(56) References Cited

U.S. PATENT DOCUMENTS

| | | | |
|---|---|---|---|
| 4,945,887 | A | 8/1990 | Sakurai et al. |
| 5,690,062 | A | 11/1997 | Yamada |
| 6,571,763 | B1 | 6/2003 | Bakker |
| 6,619,274 | B2 | 9/2003 | Miyashita et al. |
| 7,258,097 | B1 | 8/2007 | Snyder et al. |
| 2005/0011478 | A1 | 1/2005 | Neal |

FOREIGN PATENT DOCUMENTS

JP 5086858 A 4/1993

*Primary Examiner* — Noah Kamen
(74) *Attorney, Agent, or Firm* — Julia Voutyras; Alleman Hall McCoy Russell & Tuttle LLP

(57) ABSTRACT

An assembly is provided herein. The assembly includes a cylinder block and a cooler coupled to the cylinder block positioned in a valley between two cylinder banks, the cooler including a lubricant passage having a first section configured to flow lubricant in an opposing direction to the flow of lubricant through a second section, the first and second sections each extending longitudinally from a first peripheral cylinder to a second peripheral cylinder in one of the cylinder banks.

23 Claims, 11 Drawing Sheets

OIL COOLER

BACKGROUND/SUMMARY

Cooling of engine lubricant can improve engine fuel efficiency and reduce degradation of the lubricant. Degraded lubricant can not only increase friction and thus reduce fuel economy, but it can also lead to increased engine wear and component degradation.

Oil coolers may be used to cool engine oil, but require increased packaging space. Moreover, various routing lines may be needed to fluidly couple the lubrication circuit to the oil cooler, increasing the difficulty of oil cooler installation and assembly. These factors can result in increased cost and overall engine size.

U.S. Pat. No. 5,690,062 discloses an oil cooler positioned in a valley between two cylinder banks in an engine. The Inventors have recognized several drawbacks with the oil cooler configuration in U.S. Pat. No. 5,690,062. Due to the flow configuration of the oil and coolant in the cooler, the heat transfer between coolant passage and the oil passages may be insufficient to cool the oil to a desired operating temperature during high load conditions. Specifically, the separation between the coolant channel and the oil channel may reduce the cooler effectiveness in removing heat from the oil. Furthermore, the relatively short length of the adjoining oil passages and coolant passages may be insufficient to provide a desired amount of cooling during engine operation, and may provide uneven cooling to the oil flowing through the oil gallery, thus leading to oil degradation.

In one approach, an assembly is provided to address at least some of the above issues. The assembly a cylinder block and a cooler coupled to the cylinder block positioned in a valley between two cylinder banks, the cooler including a lubricant passage having a first section configured to flow lubricant in an opposing direction to the flow of lubricant through a second section, the first and second sections each extending longitudinally from a first peripheral cylinder to a second peripheral cylinder in one of the cylinder banks.1. In this way, the oil cooler may provide increased cooling via the counterflow routing of coolant and oil channels through the oil cooler, while enabling reduced packaging space and easier engine assembly. For example, in one embodiment the second section of the lubricant passage may be positioned directly above the first section of the lubricant passage, increasing the compactness of the oil cooler.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE FIGURES

FIGS. 3-14 are drawn approximately to scale.

DETAILED DESCRIPTION

Various embodiments are disclosed herein related to an oil cooler positioned in a valley of a cylinder block having a flow configuration conducive to removing heat with a decreased profile. In this way, a cooler with a compact profile can provide a desired amount of lubricant cooling to the engine. Furthermore, the cooler may be removably coupled to the cylinder block. As a result, maintenance and repair of the cooler may be simplified, thereby decreasing the cost of servicing the cooler when compared to coolers that may cast into the cylinder block. Moreover, the operation of the engine is improved when increased cooling is provided to the lubricant, including increasing fuel economy, for example.

Figure 1:
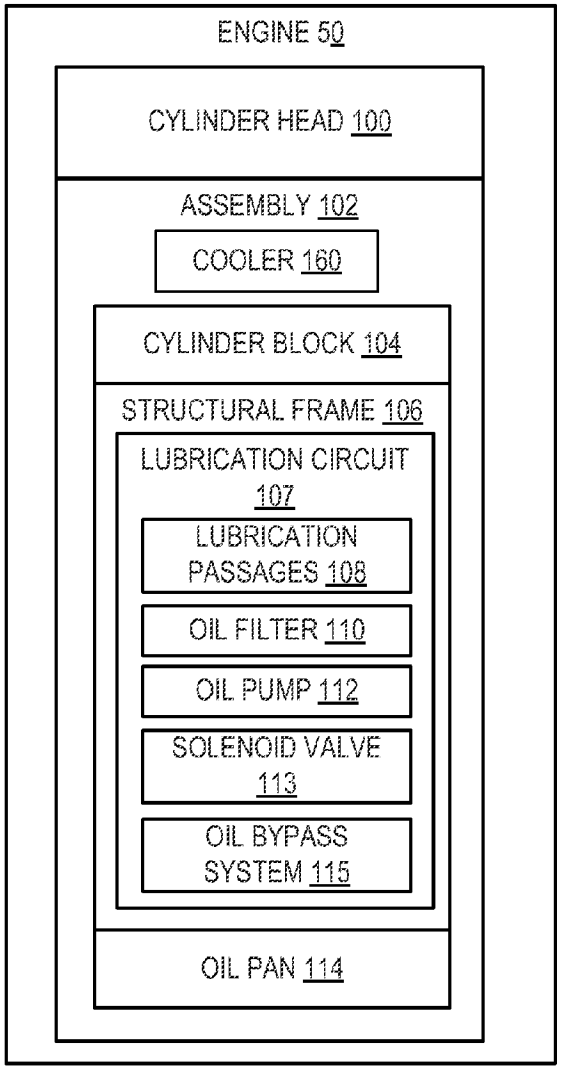
FIG. 1 shows a schematic depiction of an engine including a cooler.

Referring to FIG. 1, it shows a schematic depiction of an engine 50. Engine 50 includes a cylinder head 100 coupled to an assembly 102. It will be appreciated that the engine may further include various components for attaching the cylinder head to the assembly 102 such as a head gasket (not shown), bolts or other suitable attachment components, etc.

The cylinder head and assembly may each comprise at least one cylinder. Furthermore, engine 50 may include additional components configured to perform combustion in the at least one cylinder.

The assembly 102 may include a cylinder block 104 coupled to a structural frame 106. The structural frame may include a lubrication circuit 107 integrated therein. The lubrication circuit may include lubrication passages 108 (e.g., oil passages), oil filter 110, oil pump 112, and solenoid valve 113. The lubrication passages may be configured to provide lubrication to various engine components such as the crankshaft and crankshaft bearings. The oil filter may be coupled to a lubrication passage and configured to remove unwanted particulates from the lubrication passage. Moreover, the oil pump may also be coupled to a lubrication passage included in lubrication passages 108 and configured to increase the pressure in the lubrication circuit 107. It will be appreciated that additional integrated components may be included in structural frame 106. For example, the integrated components may include balance shafts, block heaters, actuators, and sensors.

In one example, an oil pan 114 may be coupled to structural frame 106. The oil pan may be included in the lubrication circuit. Oil pump 112 may also be coupled to structural frame 106 via bolts or other suitable fasteners. Oil pump 112 may be configured to circulate oil from oil pan 114 into lubrication passages 108. Various lubrication passages are shown in FIGS. 2 and 5-11 described in greater detail herein. Thus, the oil pump may include a pick-up disposed in the oil pan as discussed in greater detail herein with regard to FIG. 2. It will be appreciated that lubrication passages 108 may be fluidly coupled to lubrication passages included in cylinder head 100.

Engine 50 may further include a cooler 160 integrated into assembly 102. Cooler 160 may be configured to remove heat from lubrication circuit 107. In one embodiment, cooler 160 may be an oil cooler.

Figure 2:
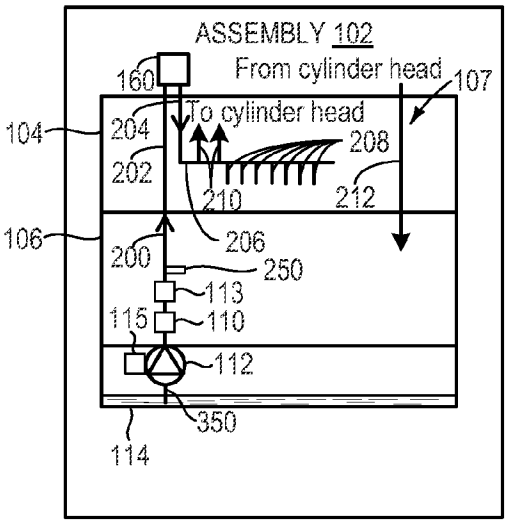
FIG. 2 shows a schematic depiction of a lubrication circuit included in the engine shown in FIG. 1.

FIG. 2 shows a schematic depiction of a lubrication system in the engine 50. It will be appreciated that the lubrication circuit may have additional complexity not shown in FIG. 2. One example, of the structural complexity of the lubrication system is described in greater detail herein with regard to FIGS. 5-14.

Referring to FIG. 2, it shows a detailed schematic depiction of lubrication circuit 107, shown in FIG. 1. As shown, the lubrication circuit 107 may be configured to direct oil or other suitable lubricant through lubrication passages in the assembly 102, and in particular, through cylinder block 104 as well as the structural frame 106. It will be appreciated that the lubrication passages may have additional complexity that is not depicted here. For example, example lubrication passages are shown in FIGS. 5-11, discussed in greater detail herein. Oil pump 112 may be configured to draw oil through the pick-up 350 disposed in oil pan 114 and flow oil into a lubrication passage 200 traversing the structural frame 106. The oil filter 110 and the solenoid valve 113 may be fluidly coupled to the lubrication passage 200. In this way, both the oil filter 110 and the solenoid valve 113 may be in fluidic communication with the lubrication passage 200. The solenoid valve 113 may be configured to decrease oil pressure in the structural frame lubrication passage 200 when a pressure of the structural frame lubrication passage exceeds a threshold value. However, alternate routing and/or positioning schemes may also be used.

For example, the depicted positioning of the oil filter and solenoid valve is one possible example. In other embodiments, the oil filter 110 and solenoid valve 113 may be positioned in alternate suitable locations. The lubrication passage 200 may be fluidly coupled to a lubrication passage 202 traversing the cylinder block 104. The lubrication passage 2002 may be in fluidic communication with the cooler 160. As previously discussed, the cooler 160 may be configured to remove heat from the lubricant (e.g., oil) in the lubrication circuit. In some embodiments, the cooler 160 may include water passage for transferring heat from the lubricant to the water.

Lubrication passage 204 shown traversing a portion of the cylinder block 104 may be fluidly coupled to an outlet of the cooler 160. In this way, lubricant may be flowed from the cooler 160 to the lubrication passage 204.

The lubrication passage 204 may be in fluidic communication with a supply oil gallery passage 206. A plurality of branch oil gallery passages 208 may be fluidly coupled to the supply oil gallery passage 206.

The branch oil gallery passages 208 may be configured to provide components of the crankshaft such as journals, bearing, etc., with lubricant. It will be appreciated that the outlets of the crankshaft lubrication branch passages may open into the crankcase. In this way, lubricant may be provided to the crankshaft and subsequently drained into the oil pan 114. Lubrication passages 210 respectively, may also be in fluidic communication with the supply oil gallery passage 206 and traverse a portion of the cylinder block 104. The lubrication passages 210 may be in fluidic communication with lubrication passages included in the cylinder head 100 shown in FIG. 1.

The lubrication circuit 107 may further include a return lubrication passage 212 traversing the cylinder block 104. The return lubrication passage 212 may include an inlet fluidly coupled to a cylinder head lubrication passage included in the cylinder head 100 shown in FIG. 1 and an outlet opening into the crankcase. In this way, oil may be drained into the oil pan from the cylinder head 100, shown in FIG. 2. Additionally, a pressure sensor 250 may be coupled to lubrication passage 200. The pressure sensor may be in electronic communication with controller 12.

In some examples, an amount of oil or an oil pressure provided by oil pump 112 may be varied by a controller, such as controller 12 shown in FIG. 1 or another suitable controller, according to engine operating conditions. In one example, the oil pump may be electrically driven. In other examples, the pumping efficiency of a mechanically driven pump may be adjusted via adjusting a feature of oil pump 112 (e.g., a vane or pressure regulator) or the solenoid valve 113. An oil bypass system 115 may also be included in the lubrication circuit 207. The oil bypass system 115 is discussed in greater detail herein. FIGS. 5-11 show an example routing of the lubrication circuit 107 in the assembly 102.

Figure 3:
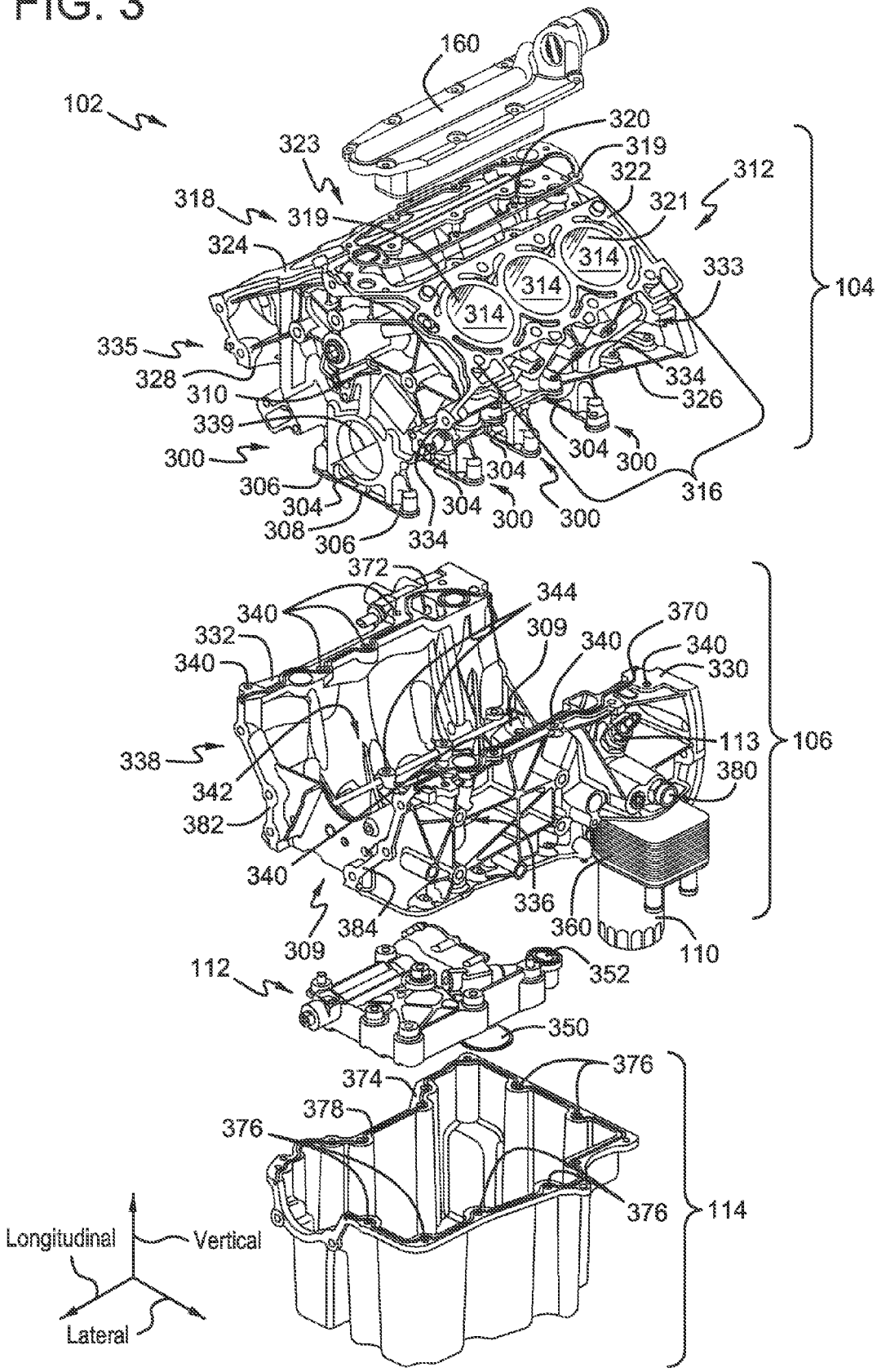
FIG. 3 shows an exploded perspective view of the cylinder block assembly shown in FIGS. 1 and 2.

Referring to FIG. 3, it shows an exploded perspective view of an example assembly 102. As depicted, assembly 102 includes cylinder block 104 positioned vertically above the structural frame 106. Pump 112 and oil pan 114 are positioned vertically below the structural frame 106. Directional vectors (i.e., the longitudinal, vertical, and lateral vectors) are provided for conceptual understanding. However, it will be appreciated that the assembly may be positioned in a number of orientations when included in a vehicle.

The cylinder block 104 further includes a plurality of crankshaft supports 300 positioned at the bottom of the cylinder block 104 and configured to structurally support a crankshaft (not shown). In some examples, the cylinder block may include two crankshaft supports. The crankshaft supports 300 may each include a bearing cap 304. The bearing caps are configured to receive a crankshaft bearing. Thus, the crankshaft supports form openings that are configured to receive crankshaft bearing (not shown) configured to enable rotation of a crankshaft (not shown). It will be appreciated that the crankshaft may include various components such as counterweights, journals, crankpin journals, etc. The crankpin journals may each be coupled to a piston via a connecting rod. In this way, combustion in the cylinders may be used to rotate the crankshaft.

The bearing caps 304 may each include two structural frame attachment recesses 306. The structural frame attachment recesses may be configured to receive a fastener such as a bolt or other suitable attachment apparatus for coupling the structural frame 106 to the cylinder block 104, discussed in greater detail herein with regard to FIG. 4. In this way, the structural frame 106 is coupled to the cylinder block 104 via the bearing caps 304. As shown, each structural frame attachment recess 306 extends vertically into the crankshaft supports 300 from a bottom surface 308 of each the bearing caps. Moreover, each structural frame attachment recess is positioned on the lateral periphery of the bottom surface 308. However in other examples, the structural frame attachment recesses may be positioned in another suitable location. Still further, in some examples the structural frame attachment recesses may have an alternate geometric configuration and/or orientation.

As shown, crankshaft supports 300 are formed from a single continuous piece of material. For example, the crankshaft supports 300 are manufactured via a single casting. Further in the depicted example, the cylinder block 104 is a one-piece engine cylinder block constructed in a single casting. However, in other embodiments the cylinder block 104 may be constructed via another suitable technique. The crankshaft supports may be cracked or otherwise divided from the cylinder block 104 after casting so that a crankshaft (not shown) may be installed. After the crankshaft is properly positioned, the pieces of the crankshaft supports may be subsequently fastened to the cylinder block after being divided from the cylinder block. In this way, the structural integrity as well as the precision of the mated interface of the crankshaft supports may be increased when compared to other cylinder block designs which may couple separately constructed (e.g., cast) upper and lower pieces of the cylinder block to form the bearing cap. Moreover, NVH may also be reduced in the assembly when the crankshaft supports are constructed out of a single piece of material. Cylinder block 104 further includes an exterior front wall 310. Likewise, cylinder block 104 further includes an exterior rear wall 312.

Continuing with FIG. 3, as depicted the cylinder block 104 includes a plurality of cylinders 314. However, in other examples the cylinder block 104 may include a single cylinder. The engine 50 includes a plurality of cylinders 314. The plurality of cylinders 314 may be divided into a first and a second cylinder bank (316 and 318). The cylinder bank 316 includes a first peripheral cylinder 319 and a second peripheral cylinder 321, where the peripheral cylinder is at an end of a row of cylinders. It will be appreciated that the cylinder bank 318 also includes two peripheral cylinders. As shown, the engine may be in a V configuration in which opposing cylinders in each of the respective cylinder banks are positioned at a non-straight angle with respect to one another. In this way, the cylinders are arranged in a V. However, other cylinder configurations are possible in other examples. A valley 320 may be positioned between the first and second cylinder banks (316 and 318) in the cylinder block 104. Cooler 160 may be positioned in the valley when the assembly 102 is assembled. A gasket 319 may be positioned between the oil cooler 160 and the cylinder block 104.

Cylinder block 104 further includes a first cylinder head engaging surface 322 positioned at a top 323 of the cylinder block. Additionally in the depicted example, the cylinder block includes a second cylinder head engaging surface 324. However in other examples, the cylinder block may include a single cylinder head engaging surface. The first and second cylinder head engaging surface (322 and 324) may be configured to couple to cylinder head 100 shown in FIG. 1. Suitable attachment apparatuses, such as bolts, may be used to couple the cylinder head 100 to the cylinder block 204 in some examples. When assembled the cylinder head 100, shown in FIG. 1, and the cylinder block 104 are attached, combustion chambers may be formed in which combustion may be implemented. For example, a four stroke combustion cycle (e.g., intake, compression, power, and exhaust) may be implemented. Suitable attachment apparatuses (not shown) may be used to couple the cylinder head 100, shown in FIG. 1, to the cylinder block 104. Additionally, a seal (e.g., gasket) may be positioned between cylinder head 100 and the first and second cylinder head engaging surfaces (322 and 324) to seal the cylinders.

Cylinder block 104 further includes two structural frame engaging surfaces (326 and 328) configured to attach to two corresponding cylinder block sidewall engaging surfaces (330 and 332) included in the structural frame 106 discussed in greater detail herein. The two structural frame engaging surfaces (326 and 328) are positioned on opposing sides of the cylinder block 204. In the perspective view of the assembly 102 shown in FIG. 3, the second structural frame engaging surface 328 cannot be fully viewed. As depicted, the structural frame engaging surfaces (326 and 328) include a plurality of fastener openings 334. The fastener openings 334 may be configured to receive fasteners such as bolts when coupled to the structural frame 106.

Cylinder block 204 further includes a first exterior sidewall 333 and a second exterior sidewall 335. The first cylinder block exterior sidewall 333 extends from the first cylinder head engaging surface 322 to the first structural frame engaging surface 326 positioned between a centerline 339 of the plurality of crankshaft supports 300. Likewise, the second cylinder block exterior sidewall 335 extends from the second cylinder head engaging surface 324 to the second structural frame engaging surface 328 positioned between the centerline 339 of the plurality of crankshaft supports 300. As shown, the structural frame engaging surfaces (326 and 328) are substantially planar. However, in other examples, the structural frame engaging surface may have another geometric configuration. For example, the height of the structural frame engaging surfaces may vary.

Furthermore, the structural frame 106 includes a bottom surface 309 and two exterior sidewalls (i.e., a first structural frame exterior sidewall 336 and a second structural frame exterior sidewall 338. The first structural frame exterior sidewall 336 extends from the bottom surface 309 and includes the first cylinder block sidewall engaging surface 330. Likewise, the second structural frame exterior sidewall 338 extends from the bottom surface 309 and includes the second cylinder block sidewall engaging surface 332. Furthermore, the first and second structural frame exterior sidewalls (336 and 338) extend above a top of the crankshaft supports 300 when the assembly 102 is assembled. Additionally, the bottom surface 309 is below the crankshaft supports 300. However, in other examples other configurations are possible. For example, the first and second structural frame exterior sidewalls (336 and 338) may not extend above a top of the crankshaft supports. As depicted, the structural frame has a U shape. However, in other examples, other shapes are possible. The cylinder block sidewall engaging surfaces (330 and 332) are configured to attach to the structural frame engaging surfaces (326 and 328) on the cylinder block 104 and are positioned on opposite sides of the structural frame 106. In the depicted example, the cylinder block sidewall engaging surfaces (330 and 332) form top surfaces of the structural frame. However, in other examples, other configurations are possible. The cylinder block sidewall engaging surfaces (330 and 332) include a plurality of fastener openings 340 along their lengths. As shown, the cylinder block sidewall engaging surfaces (330 and 332) are substantially planar and congruent a lateral and longitudinal plane. However, in other examples, alternate geometric configurations and orientations are possible. For example, the vertical height of the sidewall engaging surfaces may vary.

The structural frame may further include a front cover engaging surfaces (382 and 384) extending along at least a portion of the structural frame exterior sidewalls (336 and 338). A first seal 370 may be positioned between the first cylinder block sidewall engaging surface 330 and the first structural frame engaging surface 326. Likewise, a second seal 372 may be positioned between the second cylinder block sidewall engaging surface 332 and the second structural frame engaging surface 328. The first and second seals (370 and 372) may be substantially air and liquid tight. Example seals include but are not limited to a gasket, an adhesive, etc.

The structural frame 106 includes an interior portion 342 adjacent to the crankshaft supports 300 when the assembly 102 is assembled. The interior portion 342 includes fastener openings 344 configured to receive suitable fasteners such as bolts. As discussed in greater detail herein, the fasteners may extend through the fastener openings 344 in the structural frame 106 as well as the attachment recesses 306 in the cylinder block 104.

In some examples, cylinder block 104 and structural frame 106 may be constructed out of different materials. Specifically in one example, cylinder block 104 may be constructed out of a material having a greater strength to volume ratio than structural frame 106. However, in other examples, the cylinder block and structural frame may be constructed out of substantially identical materials. Example materials that may be used to construct the cylinder block include a gray iron, compacted graphite iron, ductile iron, aluminum, magnesium, and/or plastic. Example materials used to construct the structural frame include gray iron, compacted graphite iron, ductile iron, aluminum, magnesium, and/or plastic. In one particular example, the cylinder block may be constructed out of a compacted graphite iron and the structural frame may be constructed out of aluminum. In this way, increased structural integrity may be provided to locations in the assembly that experience greater stress, such as the combustion chambers and surrounding areas. Moreover, the volumetric size of the assembly may be reduced when the aforementioned combination of materials is utilized in the assembly as opposed to a cylinder block constructed only out of aluminum. Still further, the structural frame may be constructed out of a material having a greater strength to weight ratio than the material used to construct the cylinder block, thereby enabling weight reduction of the assembly 102.

The assembly 102 further includes oil pan 114 positioned vertically below the structural frame 106 and cylinder block 104. When assembled, oil pump 112 may be coupled to an oil pan engaging surface located on a bottom side of the structural frame. Moreover, the oil pump includes pick-up 350 positioned in the oil pan when the assembly is assembled and an outlet port 352 configured to deliver oil to a lubrication passage 200, shown in FIG. 2, in the structural frame 106. In this way, the oil pump 112 may receive oil from the oil pan 214. The assembly 102 further includes oil filter 110. The oil filter may be coupled to a plate body cooler 360. In this way, the oil filter includes an oil cooler. Plate body cooler 360 cools engine oil as it is circulated throughout the engine. The assembly 102 further includes oil pan 114. The oil pan includes a third structural frame engaging surface 374 having fastener openings 376 for receiving fasteners.

The structural frame 106 further includes a sensor mounting boss 380 for receiving a sensor, such as an oil pressure sensor. As shown, the sensor mounting boss 380 is positioned on the first structural frame exterior sidewall 336. However, the sensor mounting boss may be positioned in another suitable location such as on the second structural frame exterior sidewall 338 in other examples.

Figure 4:
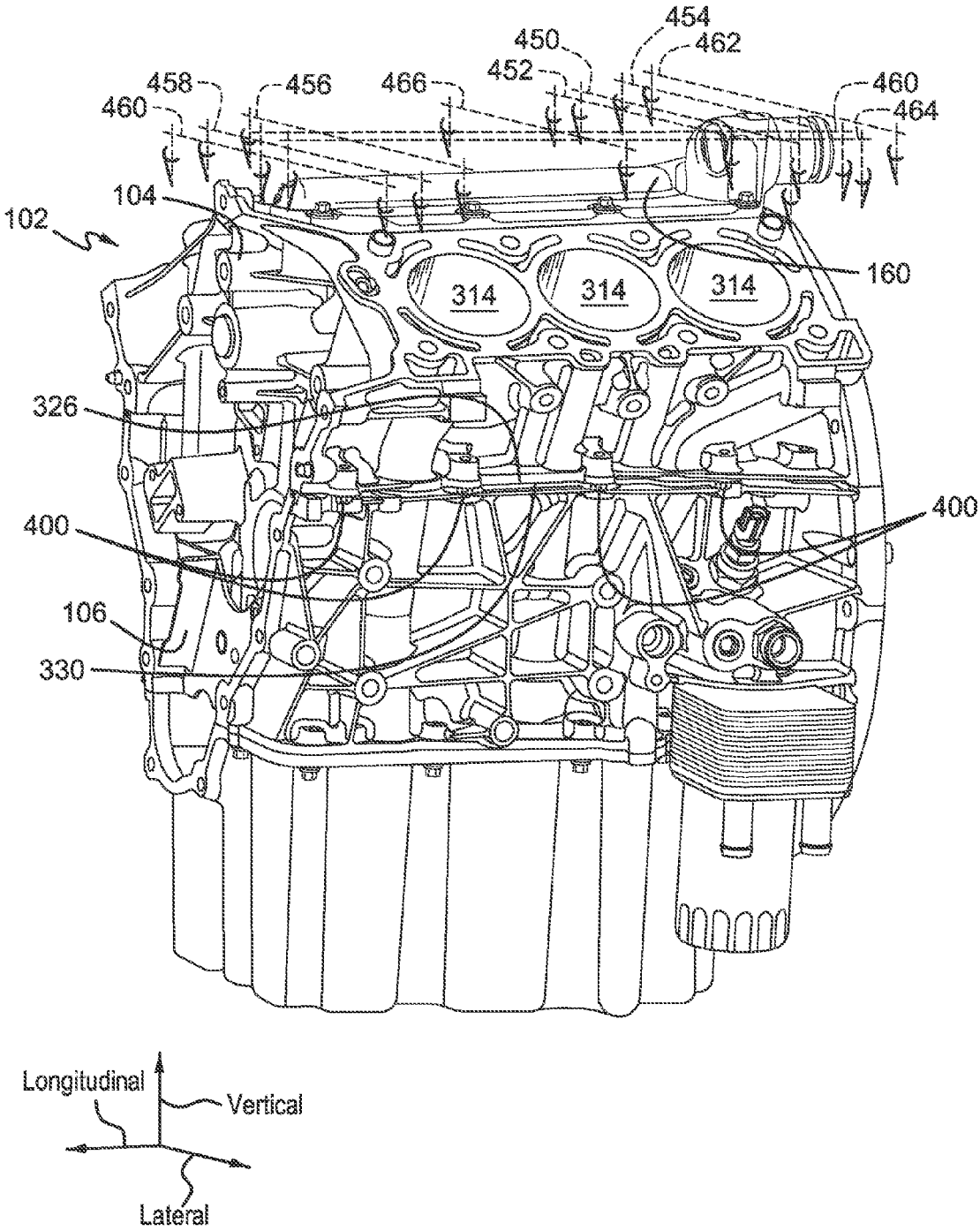
FIG. 4 shows the cylinder block assembly shown in FIG. 3 assembled.

FIG. 4 shows another perspective view of the assembly 102 in an assembled configuration. As shown, the cylinder block 104 is attached to the structural frame 106. As shown, the first and second cylinder block sidewall engaging surface (330 and 332) on the structural frame 106 may be coupled to corresponding structural frame engaging surfaces (326 and 328). It will be appreciated that the structural frame engaging surfaces and cylinder block sidewall engaging surfaces may be corresponding contoured to attach to on another such that the surfaces are in face sharing contact. However, in some examples seals may be positioned between the engaging surfaces as previously discussed.

Fasteners 400 extend through fastener openings (334 and 340) in both of the structural frame engaging surfaces (326 and 328) and the cylinder block sidewall engaging surfaces (330 and 332). In this way, the engaging surfaces may be secured to one another. Although FIG. 4 shows a single side of the assembly 102 in which the engaging surfaces are attached it will be appreciated that engaging surfaces on the opposing side of the assembly may also be coupled. Cutting planes (450, 452, 454, 456, 458, 460, 462, and 464) define the cross-sections shown in FIGS. 5-10, and 12-14, respectively.

Figure 5:
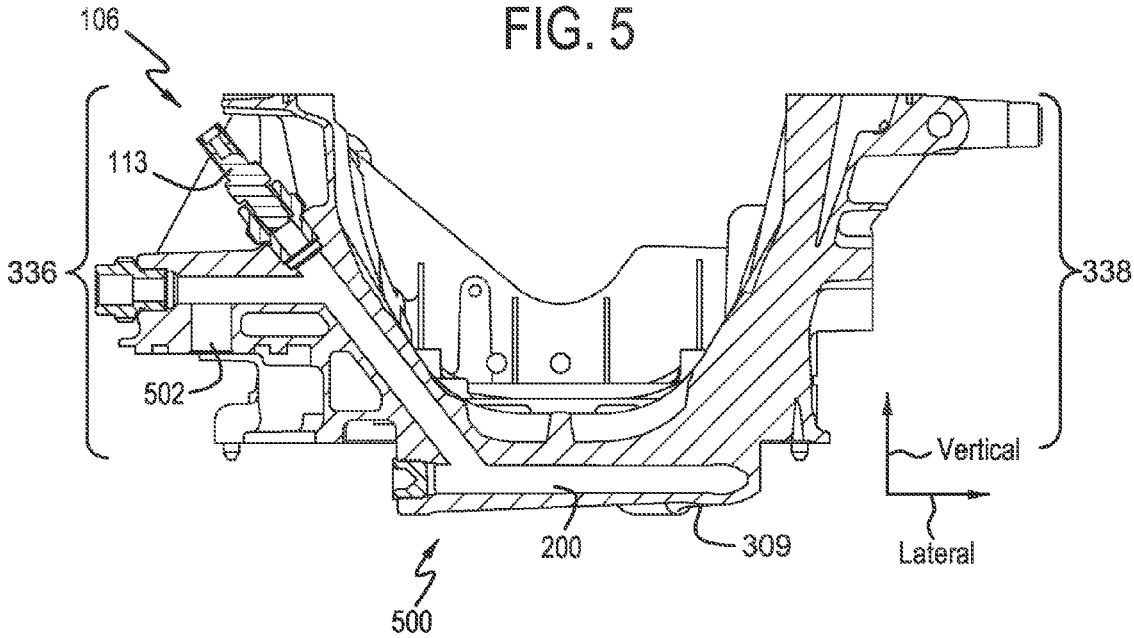
FIGS. 5-14 show various cross-sectional views of the cylinder block assembly shown in FIG. 4.

FIG. 5 shows a cross-section of the structural frame 106. As shown, a structural frame lubrication passage 200, included in the lubrication circuit 107 shown in FIG. 2, may extend through the first structural frame exterior sidewall 336 as well as through a bottom portion 500 of the structural frame 106. The bottom portion 500 may extend from the first structural frame exterior sidewall 336 to the second structural frame exterior sidewall 338. Specifically, the structural frame lubrication passage 200 is adjacent to the bottom surface 309. Furthermore, the lubrication passage 200 traverses a portion of the structural frame 106 adjacent an end of the structural frame that attaches to the transmission bell housing. However, in other embodiments, the lubrication passage 200 may be positioned in another location in the structural frame 106.

As previously discussed, the solenoid valve 113 is fluidly coupled to the lubrication passage 2000. The solenoid valve may be configured to decrease the pressure in the lubrication passage 2000 when the pressure in the passage exceeds a threshold value. However, in other embodiment the solenoid valve may have an alternate functionality. The inlet 510 shown in FIG. 5 may be the inlet of lubrication passage 200. The inlet 510 may be fluidly coupled to the outlet 352 of the pump 112, shown in FIG. 3. In this way, lubrication passage 200 is supplied with oil from the pump 212. Furthermore, the oil filter 210, shown in FIG. 3 may be fluidly coupled to the structural frame lubrication passage 200. As previously discussed, the oil filter 110 may be configured to remove contaminants from the oil in the lubrication circuit 107, shown in FIG. 2.

Figure 6:
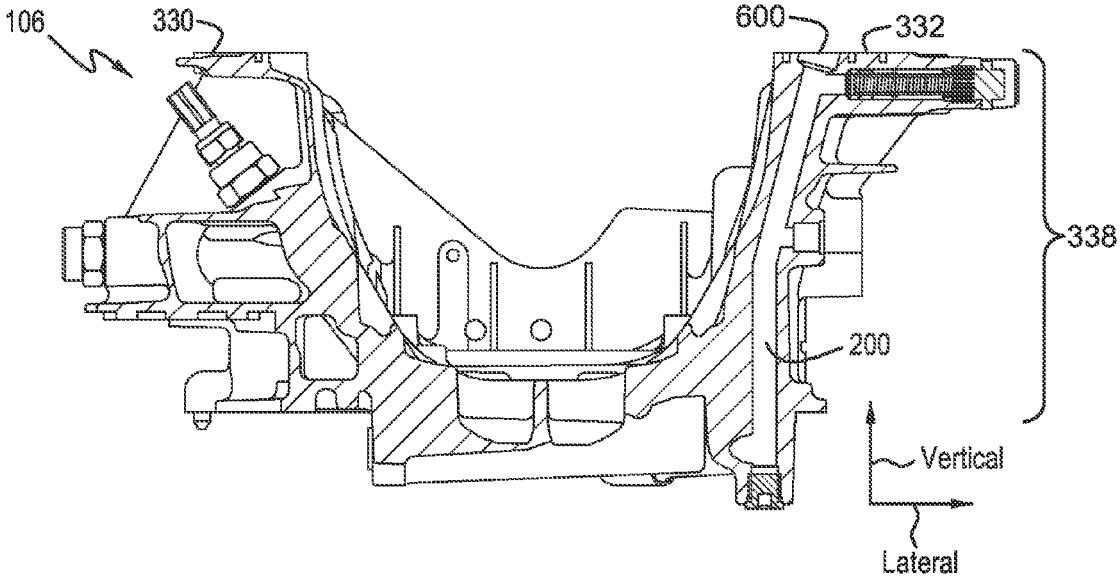

FIG. 6 shows another cross-section of the structural frame 106 including another portion of the structural frame lubrication passage 200, shown in FIG. 5. As shown in FIG. 6, the structural frame lubrication passage 200 traverses the second structural frame exterior sidewall 338. The structural frame lubrication passage 200 is laterally offset. However, in other embodiments other alignments are possible. For example, the structural frame lubrication passage 200 may be laterally aligned in other embodiments. The structural frame lubrication passage 200 also includes an outlet 600. As shown, the outlet 600 is positioned in the second cylinder block sidewall engaging surface 332. However, in other embodiments the outlet may be positioned in the first cylinder block sidewall engaging surface 330. In this way, the outlet 600 is located at one of the first and second cylinder block sidewall engaging surfaces (330 and 332). However in other embodiments, the outlet 600 may be positioned in another suitable location such as in one of the structural frame exterior sidewalls (336 and 338).

Further in the depicted embodiment the structural frame lubrication passage is adjacent to an end of the structural frame that attaches to a transmission bell housing. However, in other embodiments the structural frame lubrication passage 200 may be spaced away from the end of the structural frame that attaches to the transmission bell housing.

It will be appreciated that when the lubrication passage is integrated into the structural frame 106, external lubrication lines may not be needed to route lubricant from the pump. As a result, the compactness of the engine may be increased. Furthermore, the likelihood of rupturing a lubrication line during installation may be reduced and in some cases substantially eliminated when lubrication passages are internally routed through the structural frame.

Figure 7:
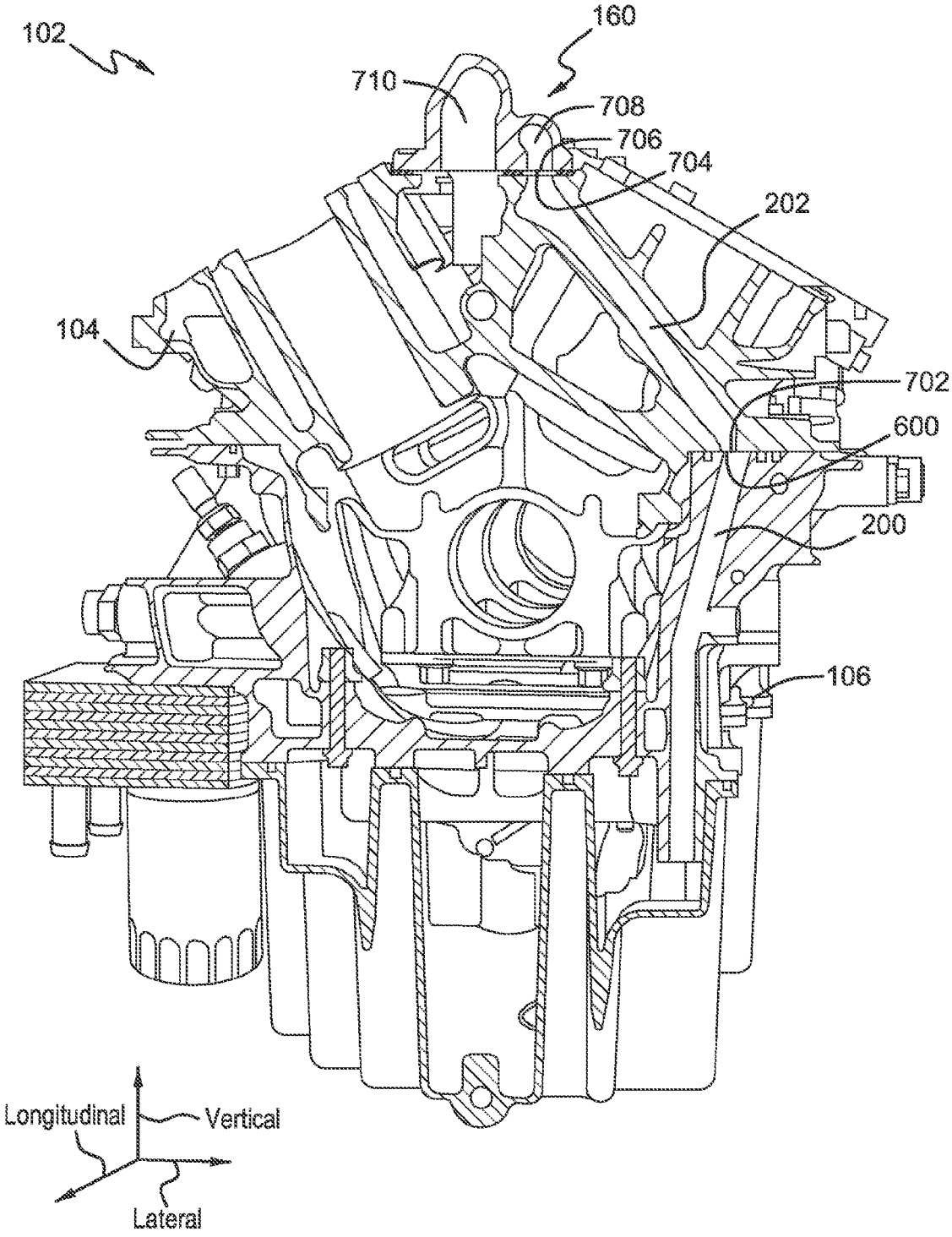

FIG. 7 shows a cross-sectional view of the assembly 102. As shown, a cylinder block lubrication passage 202 is included in the cylinder block 104. The cylinder block lubrication passage 202 includes an inlet 702 in fluidic communication with the outlet 600 of the structural frame lubrication passage 200. In this way, the cylinder block lubrication passage 202 provides fluidic communication between the second structural frame engaging surface 328 and the second cylinder block sidewall engaging surface 332. However, in other embodiments the lubrication passages may be positioned in other suitable locations. For example, the cylinder block lubrication passage 202 may provide fluidic communication between the first structural frame engaging surface 326 and the first cylinder block sidewall engaging surface 330.

The cylinder block lubrication passage 202 may further include an outlet 704. The outlet may be fluidly coupled to an inlet 706 of the cooler 160. As shown, the cooler 160 is positioned the valley 320 between the first and second cylinder banks (316 and 318), shown in FIG. 3. Continuing with FIG. 7, the inlet 706 of the cooler 160 is fluidly coupled to an inlet lubricant passage 708. The inlet lubricant passage 708 may be fluidly coupled to lubricant passage 1302 in the cooler 160, shown in FIG. 13 and discussed in greater detail herein. Cooler 160 may also include another passage 710 through which coolant is routed.

Figure 8:
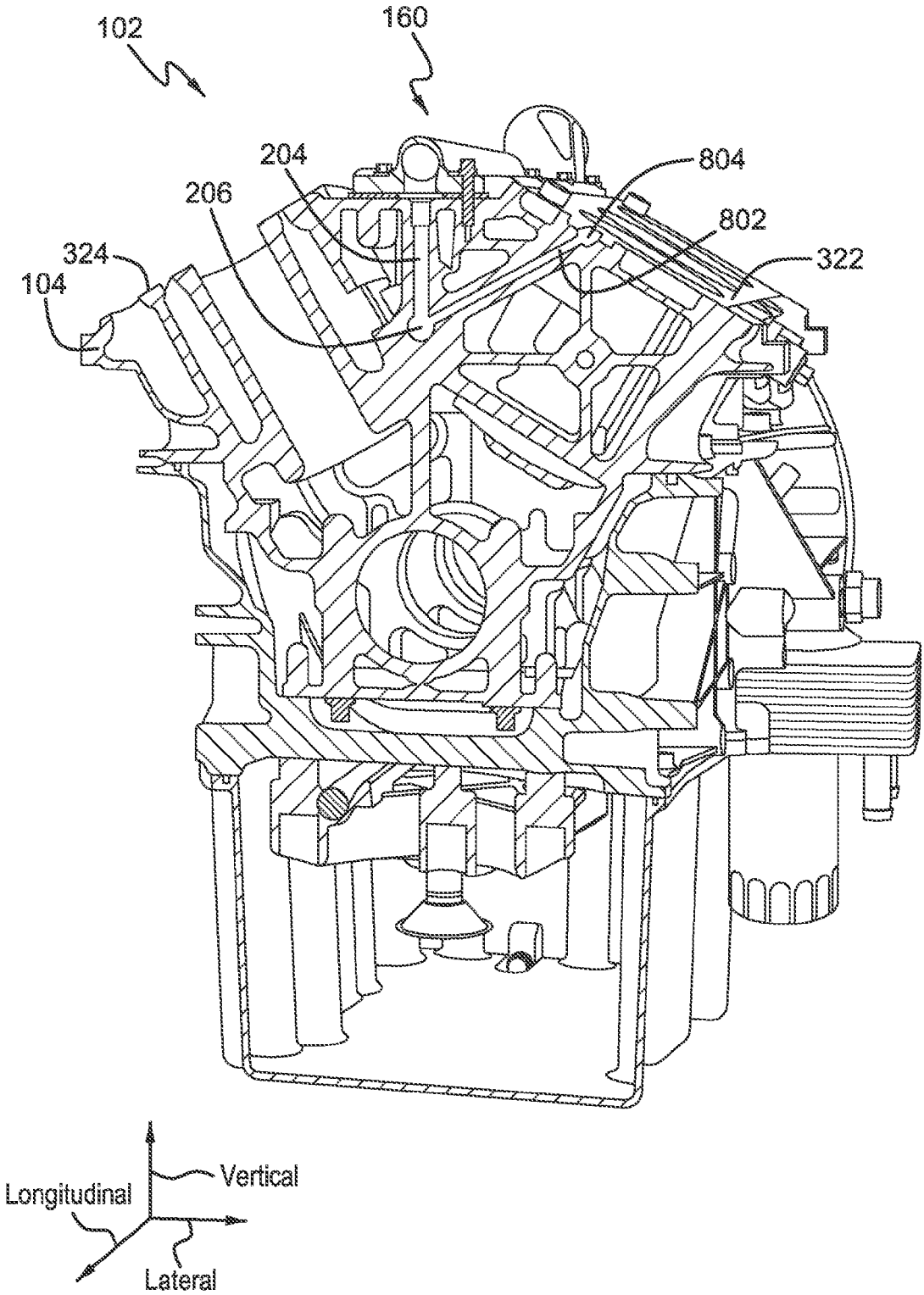

FIG. 8 shows another cross-sectional view of the assembly 102. A passage in the cooler 160 is in fluidic communication with lubrication passage 204. The lubrication passage 204 is in fluidic communication with the supply oil gallery passage 206 and the lubrication passage 802. It will be appreciated that lubrication passage 802 is one of lubrication passages 210 schematically depicted in FIG. 2. The lubrication passage 204 extends vertically through the cylinder block 104. Additionally, the lubrication passage 204 may be adjacent to the exterior front wall 310, shown in FIG. 3, of the cylinder block 104. However, in other embodiments alternate orientations are possible. The lubrication passage 802 extends through the cylinder block 104 to the first cylinder head engaging surface 322 adjacent to a cylinder. However, in other embodiments alternate orientations are possible. For example, the lubrication passage 802 may extend through the cylinder block 204 to the second cylinder head engaging surface 324. An outlet 804 of the lubrication passage 802 may be fluidly coupled to a lubrication passage (not shown) in the cylinder head 100, shown in FIG. 2.

Figure 9:
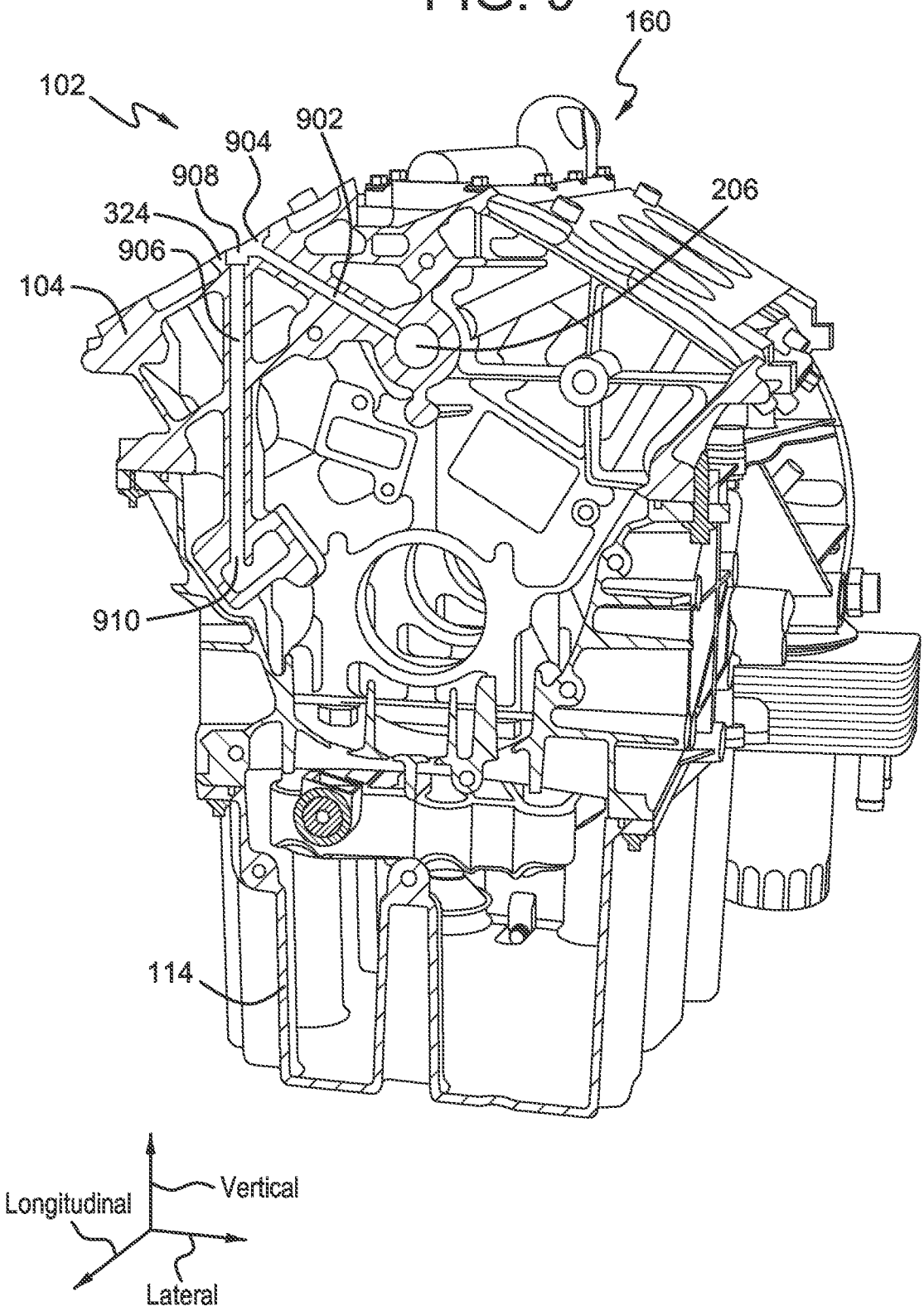

FIG. 9 shows another cross-sectional view of the assembly 102. Another section of the supply oil gallery passage 206 is depicted. A lubrication passage 902 included in the plurality of lubrication passages 210 may be in fluidic communication with the supply oil gallery passage 206. The lubrication passage 902 includes an outlet 904 that may be coupled to a lubrication passage (not shown) in the cylinder head 100 shown in FIG. 3. The lubrication passage 902 extends through the cylinder block 104 to the second cylinder head engaging surface 324. The lubrication passage 902 may also be adjacent to the exterior front wall 310, shown in FIG. 3, of the cylinder block 104. However, in other embodiments the lubrication passage 902 may have another orientation and/or location. The lubrication passage 906 also extends through the cylinder block 104. The lubrication passage 906 includes an inlet 908 and an outlet 910. The inlet 908 may be fluidly coupled to a lubrication passage (not shown) in the cylinder head 100, shown in FIG. 2. The outlet 910 may open into the crankcase of the engine 50, shown in FIG. 1, or may be fluidly coupled to a lubrication passage opening into the crankcase. In this way, oil may be flowed back into the oil pan 214. Additionally or alternatively, the outlet 910 of the lubrication passage 902 may be fluidly coupled to the lubrication passage 906.

Figure 10:
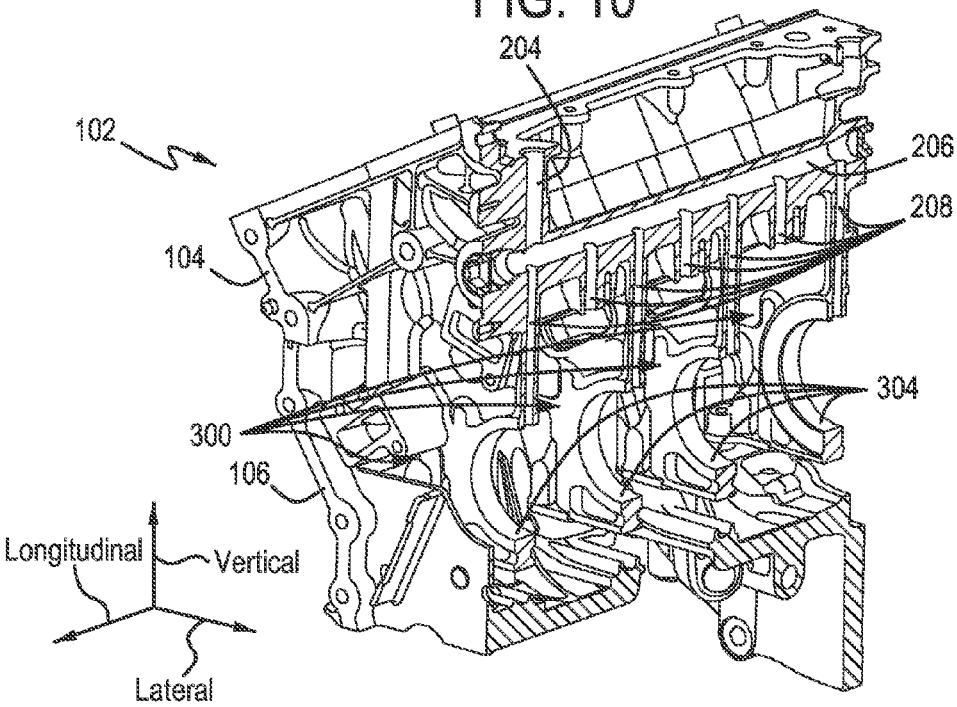

FIG. 10 shows a cross-section of the cylinder block 104. FIG. 10 shows the supply oil gallery passage 206. As previously discussed, the supply oil gallery passage 206 longitudinally traverses the cylinder block 104 and is adjacent to the bearing caps 304 included in the cylinder block 104. Branch oil gallery passages 208 are fluidly coupled to the supply oil gallery passage 206. As shown, the branch oil gallery passages 208 extend vertically through the cylinder block 104. In this way, the branch oil gallery passages 208 may be vertically oriented. However, in other examples, alternate orientations are possible. The branch oil gallery passages 208 may include outlets opening into a crankcase. A portion of the oil gallery branch passages 208 extend through the bearing caps 304, thereby providing lubrication to the crankshaft bearing. In this way, at least one of the crankshaft lubrication branch passages may extend through a portion of one of the crankshaft supports 300. Another portion of oil gallery branch passages 208 extend towards piston cooling jets, thereby cooling pistons for more optimal engine operation. In this way, increased lubrication may be provided to various engine components. Moreover, in previous engines having a V type cylinder configuration, the depression between the cylinder banks is vacant of components. In this way, increased lubrication may be provided to the engine without decreasing the engine's compactness. Of course, the diameter of the oil gallery branch passages 208 may vary from branch to branch so that similar amounts of oil may be transferred to each crankshaft bearing.

In this way, lubricant may be routed internally through the assembly 102. As a result the compactness of the assembly may be increased. When lubricant is internally routed through the assembly the number of external lubrication lines in the assembly may be reduced and in some cases eliminated. As a result, the assembly of the assembly 102 may be simplified, thereby reducing manufacturing costs. Furthermore, when fewer or no external lubrication lines are utilized the likelihood or rupturing a lubrication line during assembly is reduced and in some cases substantially eliminated.

Figure 11:
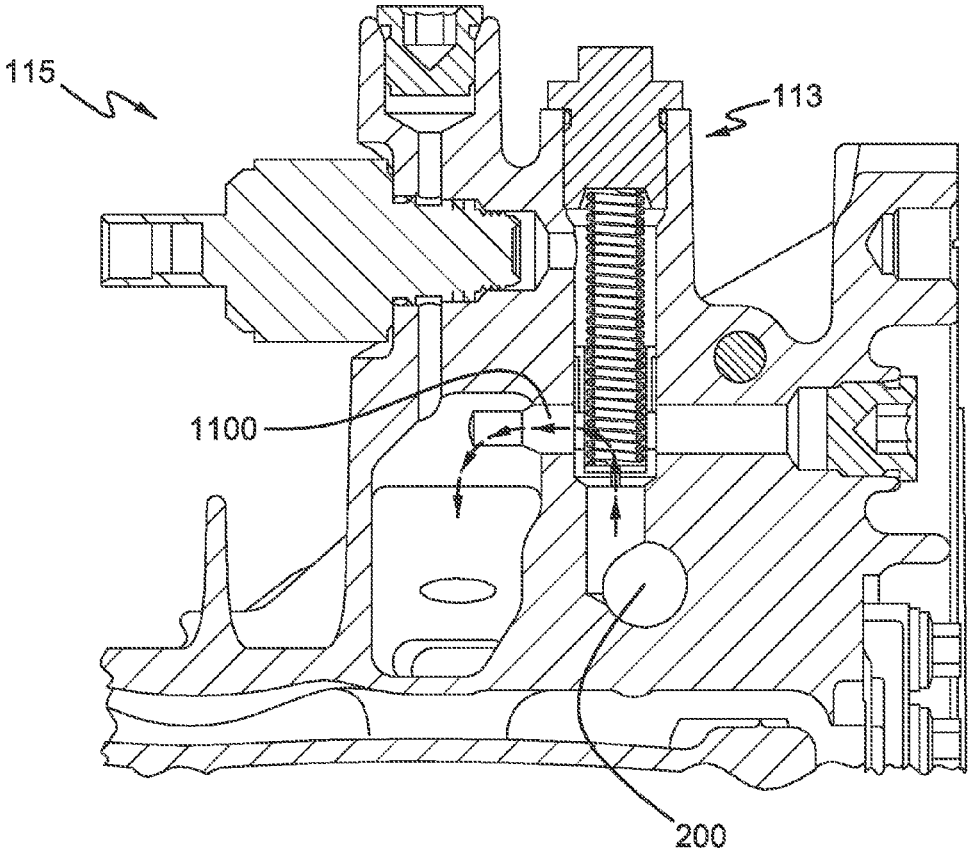

FIG. 11 shows a detailed view of an oil bypass system 115 that may be included in assembly 102. The oil bypass system may be coupled to the solenoid valve 113. Solenoid valve 113 may be configured to re-direct oil into an oil bypass passage 1100 from lubrication passage 200 during certain operating conditions such as during low flow conditions. In this way, the strain on oil pump 212 may be reduced, thereby increasing the pump's longevity. The oil bypass passage 1100 may be in fluidic communication with oil pan 114, shown in FIGS. 1, 2, and 3. Additionally, solenoid valve 113 may be actively controlled via controller 12 shown in FIG. 1.

Figure 12:
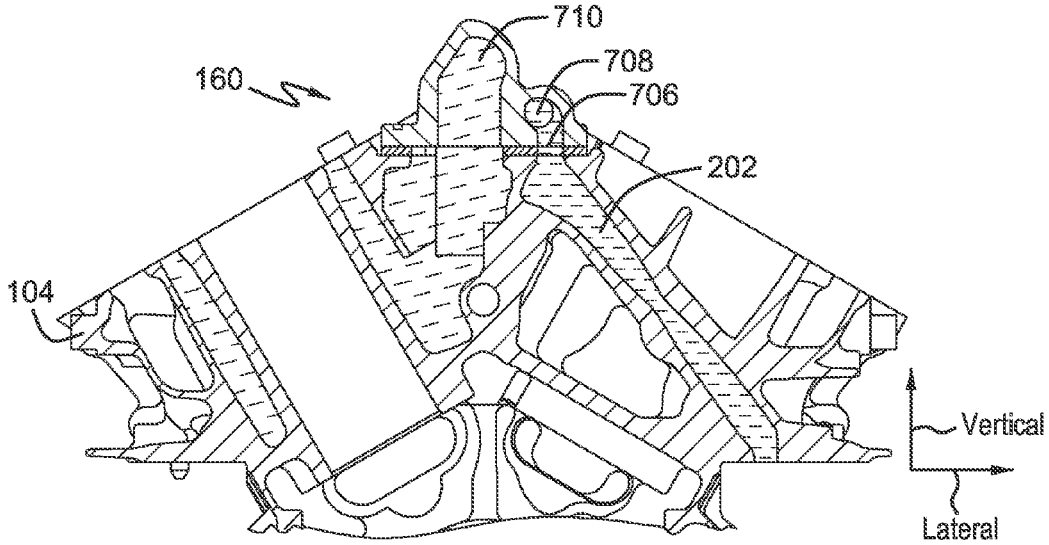
Figure 13:
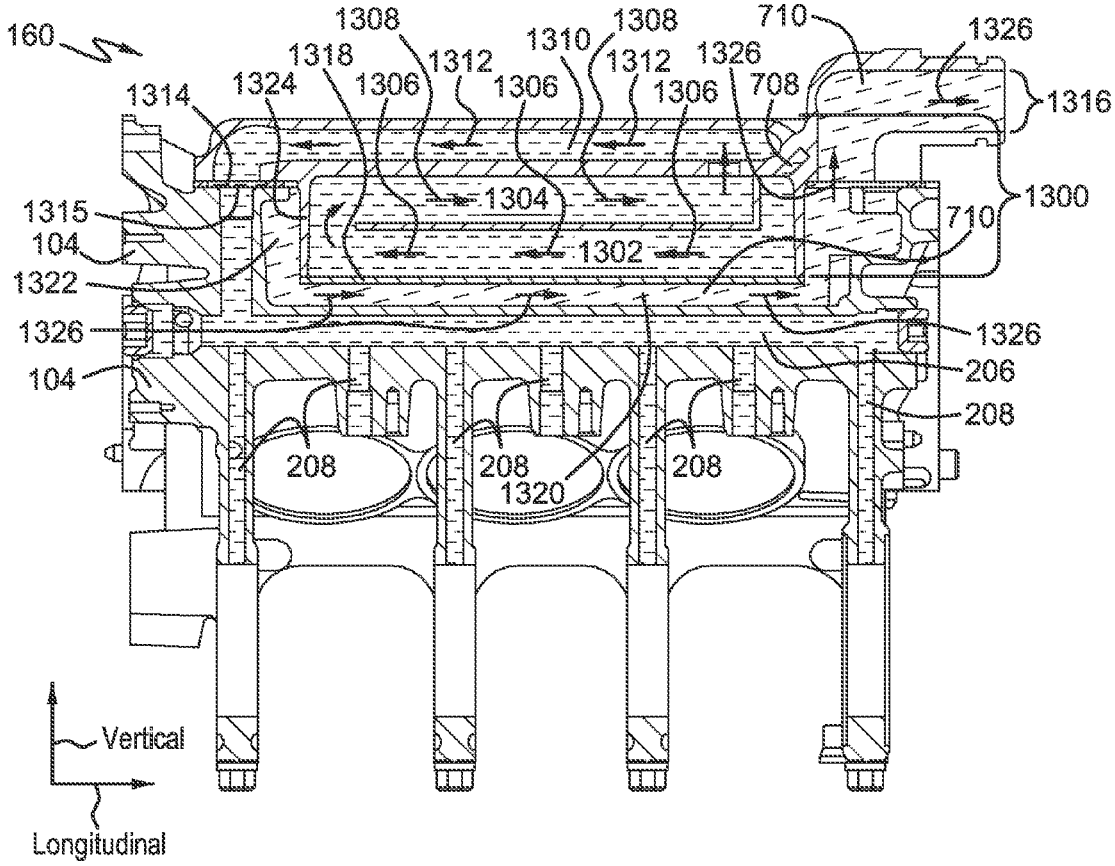
Figure 14:
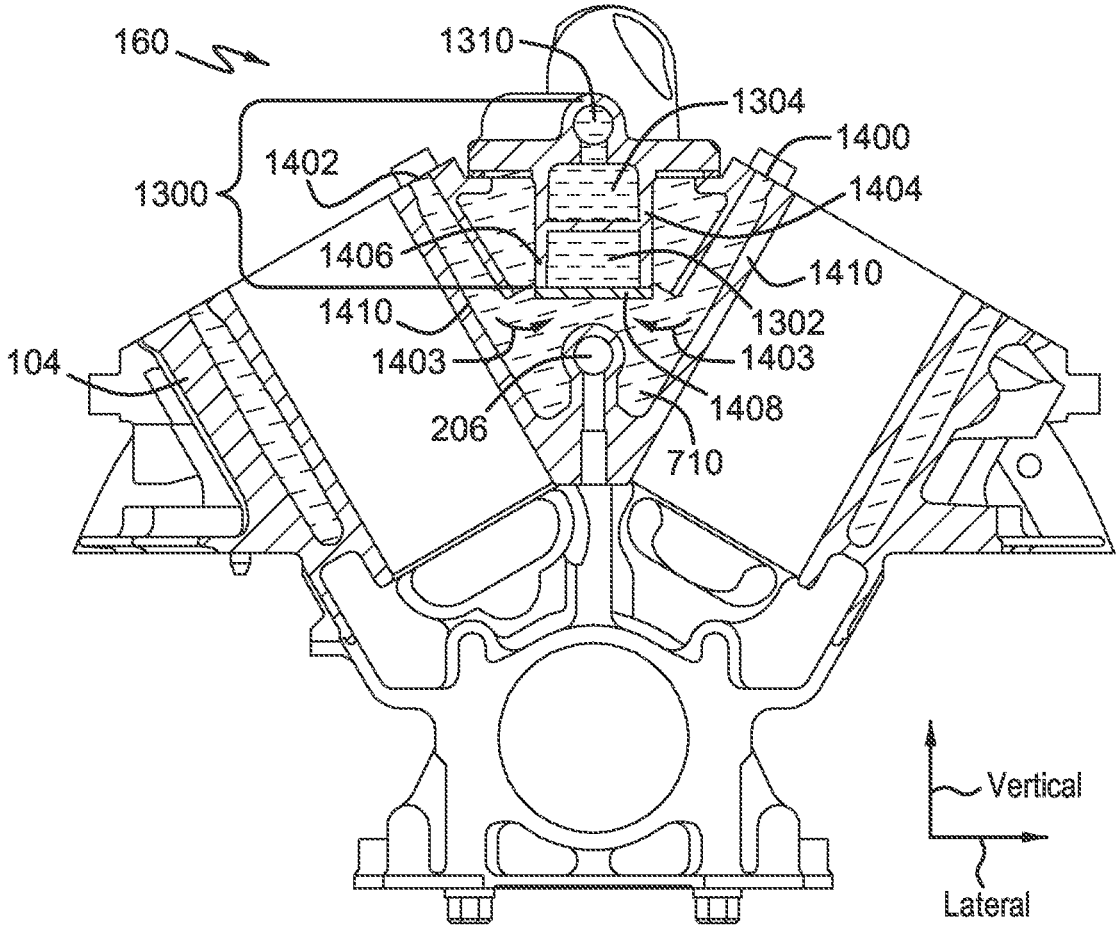

FIGS. 12-14 show cross-sectional view of an example cooler 160. It will be appreciated that the benefits of the cooler 160 are the removability of the cooler, the compact profile, as well as the configuration of the lubricant passage in the cooler that provides increased cooling.

FIG. 12 shows a first cross-section of the cooler 160. The cutting plane 462 defining the cross-section is shown in FIG. 12. As shown, the cooler 160 may include an inlet 706. The inlet 706 may be fluidly coupled to the lubricant passage 202 traversing the cylinder block 104. As previously discussed the lubricant passage 202 is fluidly coupled to the lubricant passage 200 in the structural frame 106. Lubricant passage 202 is positioned adjacent the peripheral cylinder 321 included in the cylinder bank 316, shown in FIG. 3. However, in other embodiments other positioning is possible. For example, the lubricant passage 202 may be positioned adjacent to a different cylinder.

The inlet 706 of cooler 160 is fluidly coupled to an inlet lubricant passage 708, as previously discussed. Moreover, the inlet lubricant passage 708 is also positioned adjacent to the peripheral cylinder 321, shown in FIG. 3. However, the inlet lubricant passage 708 may be positioned in a different location in other embodiments. The coolant passage 710 traversing the cooler 160 is also shown in FIG. 12 and is discussed in greater detail herein with regard to FIGS. 13 and 14.

FIG. 13 shows another cross-sectional view of the cooler 160. The cutting plane 464 defining the cross-section is shown in FIG. 4. As shown, the cooler 160 includes a lubricant passage 1300 traversing the cooler 160. The lubricant passage 1300 may be fluidly coupled to the inlet lubricant passage 708. However, in other embodiments the inlet lubricant passage 708 and the lubricant passage 1300 may be a single passage.

The lubricant passage 1300 extends in a longitudinal direction that is substantially parallel to the centerline 339 of the crankshaft, shown in FIG. 3. However, other orientations are possible in other embodiments. The lubricant passage 1300 includes a first section 1302 and a second section 1304. The first and second sections (1302 and 1304) extend from the first peripheral cylinder 319 to a second peripheral cylinder 321 in the cylinder bank 316. Likewise, the first and second sections (1302 and 1304) each extend fully from a first peripheral cylinder in the cylinder bank 318 to a second peripheral cylinder in the cylinder bank 318. In one example, a beginning of the first longitudinal section 1302 begins vertically above a first peripheral cylinder at one end of the block, and extends continuously, without bends or branches, to vertically above a second peripheral cylinder at an opposite end of the block from the first peripheral cylinder. Likewise, a beginning of the second longitudinal section 1304 begins vertically above the second peripheral cylinder, and extends continuously, without bends or branches, to vertically above the first peripheral cylinder.

Furthermore, the direction of lubricant flow in the first section 1302 may substantially oppose the direction of lubricant flow in the second section 1304. Arrows 1306 depict the general flow of lubricant in the first section 1302 and arrows 1308 depict the general flow of lubricant in the second section 1304. However, it will be appreciated that the flow pattern in the first and second sections (1302 and 1304) has additional complexity that is not depicted. It will be appreciated that the first and second sections (1302 and 1304) are fluidly coupled in series. It will be appreciated that this couterflow arrangement of the lubricant passage 1300 in the cooler 160 increases the amount of heat that may be removed from the lubricant in the cooler.

The lubricant passage 1300 may further include a third section 1310. Arrows 1312 depict the general flow direction of lubricant through the third section 1310. The general flow of the lubricant through the third section 1310 may be in the opposite direction of the second section 1304 and in the same direction of the first section 1302. When the lubricant passage 1300 is configured the amount of heat removed from the lubricant via the cooler 160 is increased. The third section 1310 is positioned near the periphery (e.g., the top) of the cooler 160. The third section 1310 includes an outlet 1314 fluidly coupled to the supply oil gallery passage 206. The supply oil gallery passage 206 may be fluidly coupled to a plurality of branch oil gallery passages 208 configured to flow lubricant to a crankshaft assembly (e.g., camshaft, journal bearings, lobes, etc.) In this way, lubrication is provided to the crankshaft assembly. As shown the branch oil gallery passages 208 extend vertically through the cylinder block 104. However, in other examples other orientations are possible. The third section 1310 is positioned vertically above the second section 1304 which is positioned vertically above the first section 1302. However, other arrangements are possible in other embodiments. It will be appreciated that the first, second, and third sections (1302, 1304, and 1310) of the lubricant passage 1300 are fluidly coupled in a series configuration.

The lubricant passage 1300 further includes an outlet 1315. The outlet 1315 is fluidly coupled to the supply oil gallery passage 206. Thus, the outlet 1315 is configured to flow lubricant into the supply oil gallery passage 206 which is positioned downstream of the outlet 1315 and the lubricant passage 1300. As previously discussed the supply oil gallery passage 206 is fluidly coupled to a plurality of branch passages 208 arranged downstream of the oil gallery passage 206. The branch passages 208 are configured to flow oil to a crankshaft assembly.

FIG. 13 further depicts the coolant passage 710. The coolant passage 710 includes an outlet 1316. It will be appreciated that coolant may be flowed from the outlet 1316 to a heat exchanger, such as a radiator, configured to remove heat from the coolant. In some embodiments, the coolant from the cooler 160 and the coolant circulated through the cylinder head and/or cylinder block may be directed to a single heat exchanger. However, in other embodiments, separate heat exchangers may be used. Subsequently, the coolant may be flowed from the coolant back to the inlets 1400 and 1402, shown in FIG. 14, of the coolant passage 710. Continuing with FIG. 13, the coolant passage 710 is configured to flow coolant along a lower side 1318 of the first section of the lubricant passage and a first and second peripheral wall, 1404 and 1406 shown in FIG. 14, of the first and second sections (1302 and 1304) of the lubricant passage 1300. In this way, the amount of heat removed from the lubricant may be increased when compared to cooler which flow coolant by a single side of a lubricant passage.

The coolant passage 710 includes a first section 1320 positioned below the lubricant passage 1300. The coolant passage 710 includes a second section 1322 adjacent to a longitudinal side 1324 of the lubricant passage 1300. Arrows 1326 depict the general flow of coolant through the coolant passage 710. However, it will be appreciated that the flow pattern of the coolant has additional complexity that is not depicted.

FIG. 14 further depicts the outlet of the coolant passage 710. The cutting plane 466 defining the cross-section shown in FIG. 14 is illustrated in FIG. 4. The coolant passage includes inlets 1400 and 1402. The inlet 1400 is positioned near cylinder bank 316 and the inlet 1402 is positioned near cylinder bank 318. However, in other embodiments the inlets 1400 and 1402 may be positioned in alternate locations and/or the number of inlets may be altered. The peripheral walls 1404 and 1406 of the lubricant passage 1300 are also shown. Additionally, the lower side 1318 of the lubricant passage 1300 is depicted. The supply oil gallery passage 206 is also shown. Arrows 1403 depict the general flow of cooling in the coolant passage 710.

Thus, the coolant passage 710 flow coolant around the peripheral walls (1404 and 1406) of the lubricant passage 1300 and a lower wall 1408 of lubricant passage 1300. Therefore, a portion of the coolant passage 710 is positioned below the lubricant passage 1300. In this way, the coolant passage 710 at least partially surrounds the lubricant passage 1300. In particular, the coolant passage 710 surrounds 3 sides of lubricant passage 1300.

Furthermore, the boundary of the coolant passage 710 may be defined by an outer surface 1410 of the cylinder block 104. However in other embodiments other configurations are possible. For instance, an outer wall of the cooler 160 may define the boundary of the coolant passage 710. The supply oil gallery passage 206 is also shown in FIG. 14.

Figure 15:
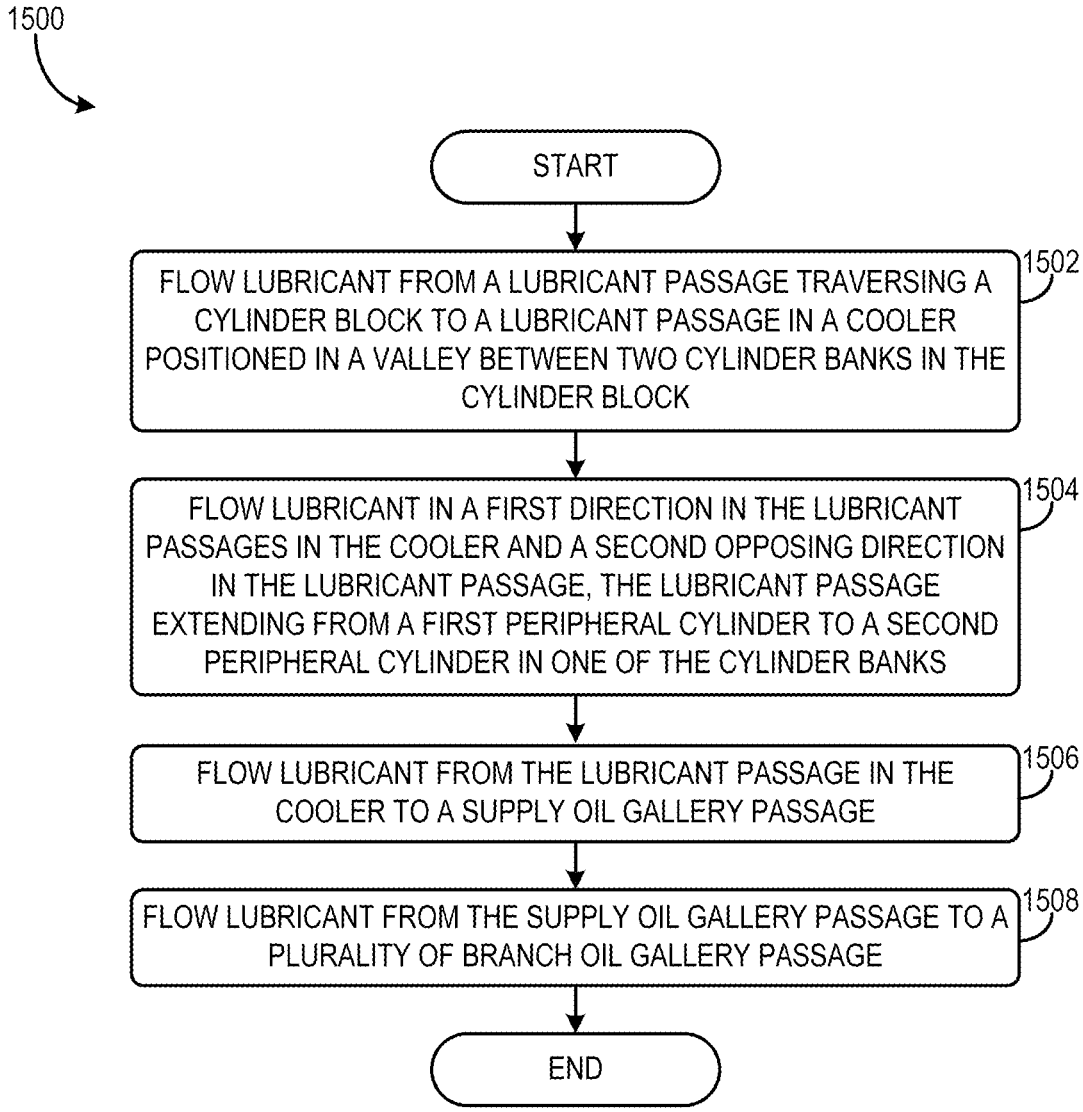
FIG. 15 shows a method for operation of an oil cooler.

FIG. 15 shows a method 1500 for operation of a lubrication circuit in an engine. It will be appreciated that method 1500 may be implemented by the engine 50 described above or alternatively may be implemented via other suitable systems, components, parts, etc.

At 1502 the method includes flowing lubricant from a lubricant passage traversing a cylinder block to a lubricant passage in a cooler positioned in a valley between two cylinder banks in the cylinder block. Next at 1504 the method includes flowing lubricant in a first direction in the lubricant passages in the cooler and a second opposing direction in the lubricant passage, the lubricant passage extending from a first peripheral cylinder to a second peripheral cylinder in one of the cylinder banks.

Next at 1506 the method includes flowing lubricant from the lubricant passage in the cooler to a supply oil gallery passage. At 1508 the method includes flowing lubricant from the supply oil gallery passage to a plurality of branch oil gallery passage.

It will be appreciated that the configurations and/or approaches described herein illustrate example embodiments, and that these specific examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An assembly comprising:

a cylinder block; and a cooler coupled to the cylinder block positioned in a valley between two cylinder banks, the cooler including a lubricant passage having a first section configured to flow lubricant in an opposing direction to the flow of lubricant through a second section, the first and second sections each extending longitudinally from a first peripheral cylinder to a second peripheral cylinder in one of the cylinder banks.

2. The assembly of claim 1, wherein the lubricant passage includes a third section positioned near the periphery of the cooler and configured to flow lubricant in a direction opposing the second section.

3. The assembly of claim 2, wherein the lubricant passage includes an outlet positioned downstream of the third section configured to flow lubricant into a supply oil gallery passage configured to flow lubricant to a plurality of branch passages positioned downstream of the third section.

4. The assembly of claim 1, wherein the cooler further comprises a coolant passage configured to flow coolant adjacent to the lubricant passage.

5. The assembly of claim 4, wherein the coolant passage at least partially surrounds the lubricant passage.

6. The assembly of claim 4, wherein a portion of the coolant passage is positioned below the lubricant passage.

7. The assembly of claim 1, wherein the cooler is removably coupled to the valley.

8. The assembly of claim 1, wherein the lubricant passage is fluidly coupled to a lubricant passage traversing the cylinder block adjacent to at least one cylinder.

9. The assembly of claim 1, wherein the lubricant passage is fluidly coupled to a lubricant passage in a structural frame.

10. The assembly of claim 1, wherein the second section is positioned vertically above the first section.

11. The assembly of claim 1, wherein the lubricant passage includes an outlet fluidly coupled to a supply oil gallery passage configured to flow lubricant to a crankshaft assembly via a plurality of branch oil gallery passages.

12. The assembly of claim 1, wherein the lubricant includes an inlet fluidly coupled to a lubricant passage traversing a structural frame.

13. The assembly of claim 1, wherein the coolant passage surrounds peripheral walls of the lubrication passage.

14. An assembly comprising:

a cylinder block including a first cylinder bank, a second cylinder bank, and a valley positioned between the two cylinder banks; and a cooler coupled to the cylinder block positioned in the valley configured to transfer heat from a lubricant to a coolant, the cooler including a lubricant passage having an inlet fluidly coupled to a cylinder block lubricant passage, an outlet fluidly coupled to an oil gallery, and a first section configured to flow lubricant in an opposing direction to the flow of lubricant through a second section, each section of the lubricant passage extending from a first peripheral cylinder to a second peripheral cylinder in the first cylinder bank, and including a coolant passage configured to flow coolant adjacent to the lubricant passage.

15. The assembly of claim 14, wherein the oil gallery includes a plurality of branch passages configured to provide lubricant to a crankshaft assembly.

16. The assembly of claim 14, wherein the cooler is removably coupled to the valley.

17. The assembly of claim 14, wherein the coolant passage includes an outlet at positioned near a top side of the cooler.

18. The assembly of claim 14, wherein the first and second sections are substantially parallel to a centerline of the crankshaft.

19. The assembly of claim 14, wherein the first cylinder bank is arranged at a non-straight angle with regard to the second cylinder bank.

20. An assembly comprising:

a cylinder block including a first cylinder bank, a second cylinder bank, and a valley positioned between the two cylinder banks;

a cooler coupled to the cylinder block and positioned in the valley configured to transfer heat from a lubricant to a coolant, the cooler including a lubricant passage having an inlet fluidly coupled to a cylinder block lubricant passage, an outlet fluidly coupled to an oil gallery, and a first section configured to flow lubricant in an opposing direction to the flow of lubricant through a second section, each section of the lubricant passage extending from a first peripheral cylinder to a second peripheral cylinder in the first cylinder bank, and including a coolant passage configured to flow coolant adjacent to the lubricant passage, the coolant passage at least partially surrounds the lubricant passage.

21. The assembly of claim 20, wherein the lubricant passage includes a third section positioned near the periphery of the cooler and configured to flow lubricant in a direction opposing the second section and an outlet positioned downstream of the third section configured to flow lubricant into a supply oil gallery passage configured to flow lubricant to a plurality of branch passages.

22. The assembly of claim 20, wherein the coolant passage includes an inlet fluidly coupled to a coolant passage traversing the cylinder block.

23. The assembly of claim 20, wherein a portion of the coolant passage is positioned vertically below the first and second section of the lubricant passage.

* * * * *